US007779664B2

(12) United States Patent
Nock et al.

(10) Patent No.: US 7,779,664 B2
(45) Date of Patent: Aug. 24, 2010

(54) DEVICE FOR THE STEPPED DISPLACEMENT OF WORK PIECES

(75) Inventors: Klemens Nock, Oberkirch-Zusenhofen (DE); Theo Pfeifer, Kappelrodeck (DE)

(73) Assignee: Edrich Beteiligungs GmbH, Renchen-Ulm (DE)

( * ) Notice: Subject to any disclaimer, the term of this patent is extended or adjusted under 35 U.S.C. 154(b) by 954 days.

(21) Appl. No.: 11/568,740

(22) PCT Filed: Apr. 22, 2005

(86) PCT No.: PCT/EP2005/004372

§ 371 (c)(1),
(2), (4) Date: Nov. 6, 2006

(87) PCT Pub. No.: WO2005/110641

PCT Pub. Date: Nov. 24, 2005

(65) Prior Publication Data

US 2007/0295052 A1 Dec. 27, 2007

(30) Foreign Application Priority Data

May 13, 2004 (DE) ..... 10 2004 023 525

(51) Int. Cl.
*B21D 43/05* (2006.01)

(52) U.S. Cl. ..... 72/405.16; 72/405.11; 198/621.1; 198/621.3

(58) Field of Classification Search ..... 72/405.11, 72/405.12, 405.13, 405.16; 198/339.1, 468.2, 198/468.9, 621.1, 621.3
See application file for complete search history.

(56) References Cited

U.S. PATENT DOCUMENTS

| | | | | |
|---|---|---|---|---|
| 5,363,685 | A | 11/1994 | Luthi et al. | |
| 5,680,787 | A * | 10/1997 | Fisch | 72/405.16 |
| 5,899,109 | A * | 5/1999 | Fisch | 72/405.16 |
| 5,906,131 | A * | 5/1999 | Fisch | 72/405.16 |
| 6,216,523 | B1 * | 4/2001 | Sofy et al. | 72/405.11 |
| 6,702,098 | B2 * | 3/2004 | Zeibig et al. | 198/468.2 |
| 6,910,362 | B2 * | 6/2005 | Childs et al. | 72/405.16 |
| 7,128,195 | B2 * | 10/2006 | Childs | 72/405.13 |
| 2003/0183485 | A1 | 10/2003 | Zeibig et al. | |

FOREIGN PATENT DOCUMENTS

| | | |
|---|---|---|
| DE | 4304902 | 8/1994 |
| EP | 0633077 | 1/1995 |
| JP | 61212435 | 9/1986 |

* cited by examiner

*Primary Examiner*—David B Jones
(74) *Attorney, Agent, or Firm*—Volpe and Koenig, P.C.

(57) ABSTRACT

A device (1) for the stepped displacement of workpieces inside a press (2) or similar processing equipment is provided. The device includes at least one or two gripper rails (4) that can be displaced back and forth in the direction of a longitudinal extent thereof and in the feed direction, the rails being displaced transversely in relation to one another in order to engage workpieces. To execute a gripping movement, the gripper rail (4) includes levers (5) that run at an angle and in opposite directions to one another, whereby the ends of the levers that face away from the gripper rail can be displaced towards or away from one another. Pivoting arms (11), which together with the levers (5) form scissors or half scissors type drives, are hinged on the levers (5) to guide the resultant transverse movement. A scissors drive of this type permits a parallel displacement of the gripper rail (4), even where space is limited, without the use of a drive that protrudes beyond the longitudinal extension of the gripper rails (4).

17 Claims, 14 Drawing Sheets

DEVICE FOR THE STEPPED DISPLACEMENT OF WORK PIECES

BACKGROUND

The invention relates to a device for the stepped displacement of work pieces, especially within a press, comprising at least one or two gripper rail(s), which can be displaced back and forth in the feed direction for the feed and return motion, which have gripper parts or gripper zones for engaging the work pieces, and which then can be moved back into the original position for engaging the work pieces and for moving in the feed direction, wherein at least two levers that can pivot parallel or mirror-symmetric to each other in the plane of motion, in a plane parallel to this plane of motion, or in a plane at an angle to this plane of motion are attached to the gripper rail(s), and for a device with two parallel gripper rails, these levers of one of the gripper rails can pivot in the opposite sense to those of the other gripper rail.

Such a device with two parallel gripper rails is known from DE 102 06 773 C1, with additional state of the art concerning such gripper rails being cited in this publication. This device has proven advantageous, primarily in presses, in which the gripper rails are arranged between the press stands overlapping in their longitudinal direction and in the feed direction of the work pieces. Here, it is favorable that only the gripper rails and the work pieces grasped by these rails, as well as possible grippers or gripper parts on the gripper rails, that is, relatively small masses, must be moved.

Presses are also known, however, in which the spacings of the press stands are too small to allow the gripper rails to project through these stands. In such presses, the gripper rails must be arranged within the intermediate spaces of the press stands and also must be moved back and forth, so that only a limited space is also available for the drive for these movements of the gripper rails.

Indeed, presses with such gripper rails are already known, in which the movements of the gripper rails run transverse to their longitudinal extent within the spacing of the press stands, but these presses require drives, which are arranged outside of the press outline and therefore special protective measures for the operator and also safety spacings are necessary due to the movements running outside of the press outline. Here, linear drives are known, which are arranged transverse to the feed motion and to the longitudinal extent of the rails, which project out of the press outline perpendicular to the gripper rails, and which require not only the mentioned safety spacings, but also make the accessibility and the ability to monitor the running of the gripping and feed motions more difficult, because a user must be positioned at a correspondingly large distance to the gripper rails.

SUMMARY

Therefore, the objective arises of creating a device of the type named above, in which the drive or drives of the gripper rails, in particular, the drives for the gripping motions, do not have to move outwards transverse to the outline of the press, in order to set the gripper rail or rails in the gripping motion and in the opposite direction. This objective also applies for a device with only one gripper rail, on which grippers for work pieces are arranged.

To meet this objective, the device defined above is characterized in that the two levers pivotably hinged to the gripper rail are attached so that their ends or zones facing away from the gripper rail are pivotally attached to sliding parts that can move towards or away from each other parallel to the direction of the gripper rail extent, and the spacing of these sliding parts can be changed for the back and forth movements of the gripper rail perpendicular to their longitudinal extent, and the gripper rail is positively driven perpendicular to its direction of longitudinal extent.

Thus, the drive for the transverse motion of the gripper rail initially causes a motion parallel to the gripper rail, namely on the sliding parts. Therefore, the levers are pivoted, whereby this parallel motion of the sliding parts is converted via the levers into a transverse motion of the gripper rail. By moving the ends of the levers facing away from the gripper rail towards or away from each other with the help of the sliding parts, the gripper rail can be adjusted parallel to itself as desired, with a positive drive providing the corresponding precise parallel adjustment. Thus, movements perpendicular to the longitudinal extent of the gripper rail can be avoided for an adjustment drive, so that the drive and the levers can be arranged within or to a large degree within the outline of the press stands, for example, between two such press stands, so that not only are there no movements past the outline of the press stands perpendicular to this outline, but the drive can also be housed to a large degree within the outline of the press or at least within the typical outline of protective doors on such presses.

The levers and the drive of the sliding parts can thus be arranged at least partially within the outline of stands of the press, in particular, between two press stands that are adjacent to each other in the feed direction. Thus, a space-saving arrangement within the press is possible not only for the gripper rails, but also for its drive, which also simplifies monitoring and control for the operator.

In addition, it is preferable when the drive for the feed movements of the gripper rail or rails is also arranged in its direction of longitudinal extent at least partially within the outline of the press stands. Thus, the gripper rails can be moved in their direction of longitudinal extent after engaging work pieces, without the drive necessary for these movements having to project a great deal past the outline or the horizontal projection of the press. According to the selection of the drive, it can also be located completely within the outline or horizontal projection of the press.

An effective and space-saving positive drive for the transverse motion of the respective gripper rail can be achieved, such that pivot arms are hinged to the levers between their attachment points to the gripper rail and the respective sliding part. These pivot arms are mounted so that they can pivot with their end facing away from the hinge point and the gripper rail on displacement elements or stationary bearings, and so that the spacing of the sliding part, on one side, and the sliding element or bearing, on the other side, can be changed or enlarged for the transverse adjustment or during the transverse adjustment of the gripper rail. Thus, the respective lever is stabilized with a pivot arm, so that the adjustment of the sliding parts leads to a safe and precise parallel adjustment of the gripper rail for changing their respective spacing.

An improvement can be provided, in that the pivot arm crosses the lever at the common hinge point and also attaches to the gripper rail via a joint, wherein the hinge points of the lever and the pivot arm pivotably mounted on this lever to the gripper rail can be changed in terms of their spacing when the gripper rail is adjusted perpendicular to itself analogous to the spacing of the displacement part and the displacement element. In this case, the gripper rail is practically engaged by one or two scissors and adjusted perpendicular to itself, while in the case, in which the pivot arm does not reach up to the gripper rail, it can be called "single-arm scissors." In comparison with a scissors-like arrangement of the lever and pivot arm, the "single-arm scissors" have the advantage that a joint close to the gripper rail can be eliminated.

For simplifying the motion profile, it is useful when the hinge point of the pivot arm facing away from the lever and the gripper rail is stationary and the adjacent hinge point of the lever located on the sliding part can move relative to the other hinge point—parallel to the longitudinal extent of the gripper rail. In this way, an adjustment element can be eliminated or at best constructed as a stationary part or bearing, on which the corresponding pivot arm has to perform only a pivoting motion. The entire kinematics are correspondingly simple for the transverse adjustment of the gripper rail by changing the spacing of the sliding part for the corresponding pivoting of the lever.

The two sliding parts of the two levers attached to one gripper rail can be moved towards each other for moving the gripper rail closer to these sliding parts and can be moved away from each other for the opposite engaging motion, and the hinge points of the pivot lever are here, in particular, stationary.

For such an arrangement of the lever and the pivot arms, as well as their respective joints, the displacement of the sliding parts is almost sufficient for changing their mutual spacing, in order to adjust the gripper rail perpendicular to this displacement motion. Thus, the entire kinematics and drive arrangement can be housed in a space-saving way within a tight space and here at least to a large extent within the outline of the press stands.

The gripper rail or rails can be moved after engaging work pieces in the direction of their longitudinal extent—thus, in the feed direction—such that the hinge points of the levers and the pivot arms facing away from the gripper rail can be moved by means of slides on a guide arranged parallel to the gripper rail and that a spindle motor or work cylinders or a linear drive, for example, is provided for this displacement motion. Slides are understood to be a part, which attaches to a guide with a counter-stay and here engages in this guide and/or wraps around the guide. With a drive that acts parallel to the extent of the gripper rail, for example, a spindle motor, the entire arrangement composed of the gripper rail, the lever, the pivot arm, and their hinge points, including sliding parts, can be moved, in order to be able to execute the desired feed motion of the gripper rail and also its return motion.

For the motion of the sliding parts in opposite directions—for the transverse movement of the gripper rail—a spindle with two opposite-direction threaded zones and spindle nuts having opposite-direction threads on the slide parts can be provided. The respective threaded zones of the spindle can engage in these spindle nuts and the spindle can have a single drive motor. For the transverse adjustment of a gripper rail, despite the two levers and the sliding parts acting on these levers, a single drive motor is sufficient for a use of an opposite-direction spindle, so that this drive can have a space-saving and economical arrangement.

The slides, which have the hinge points of the levers and the pivot arms facing away from the gripper rail and which belong to a gripper rail, can be coupled to each other or connected, in particular, via a connecting rod, so that for each gripper rail, a single feed drive can be sufficient, which can adjust these coupled slides together.

An especially useful improvement of the invention, which is favorable primarily for holding larger masses or weights, can be provided in that the pivot arm attaching to the respective lever can be moved in a plane that runs at an angle to the plane, in which the levers can move. This arrangement produces a tensile or compression load on the pivot arms, which can increase the flexural strength of the entire lever and pivot arm arrangement, so that heavier rails and/or heavier work pieces and/or light levers and/or pivot arms are allowed.

In this way, the pivot arm or arms can run at an angle upwards or downwards relative to the plane of motion of the levers independent of whether the plane of motion of the levers is arranged horizontally or also at an angle upwards or downwards relative to a horizontal plane. For reinforcing the scissors or single-arm scissors drive, it is important that the ends of the pivot arms facing away from the levers and the ends of the levers adjacent to these arms are arranged at different heights and the pivot arms move closer to the levers in the direction towards the common joint. This leads to good reinforcement of the levers and pivot arms, wherein an arrangement of the end of the pivot arm past the end of the lever makes the pivot arm into a tension rod and an arrangement underneath the end of the lever makes it into a compression rod.

It is still to be mentioned that the drive devices for the gripper rails can be mounted and moved up and down on vertical guides or threaded spindles, so that objects grasped by the gripper rails can also be raised and/or lowered. Here, a lifting unit can be provided for each press stand, which allows over-travel upwards or downwards relative to the transport plane, wherein a pneumatic mass equalization can be performed. The lifting units at the front and back in the feed direction can be connected to a base cross arm, on which the feed drive for the gripper rails can be mounted.

Primarily by combining individual or several of the prescribed features and measures, a device is produced with gripper rails, which can be housed together with their drive in a narrow space, wherein the drive for the transverse movements of the gripper rails acts parallel to these rails and is converted into corresponding transverse movements of the gripper rails via pivot levers and positive drives. Therefore, drives arranged and moving perpendicular to the gripper rails can be eliminated.

BRIEF DESCRIPTION OF THE DRAWINGS

Below, embodiments of the invention are described in more detail with reference to the drawings. Shown in partially schematic representation are.

DETAILED DESCRIPTION OF THE PREFERRED EMBODIMENTS

Figure 1:
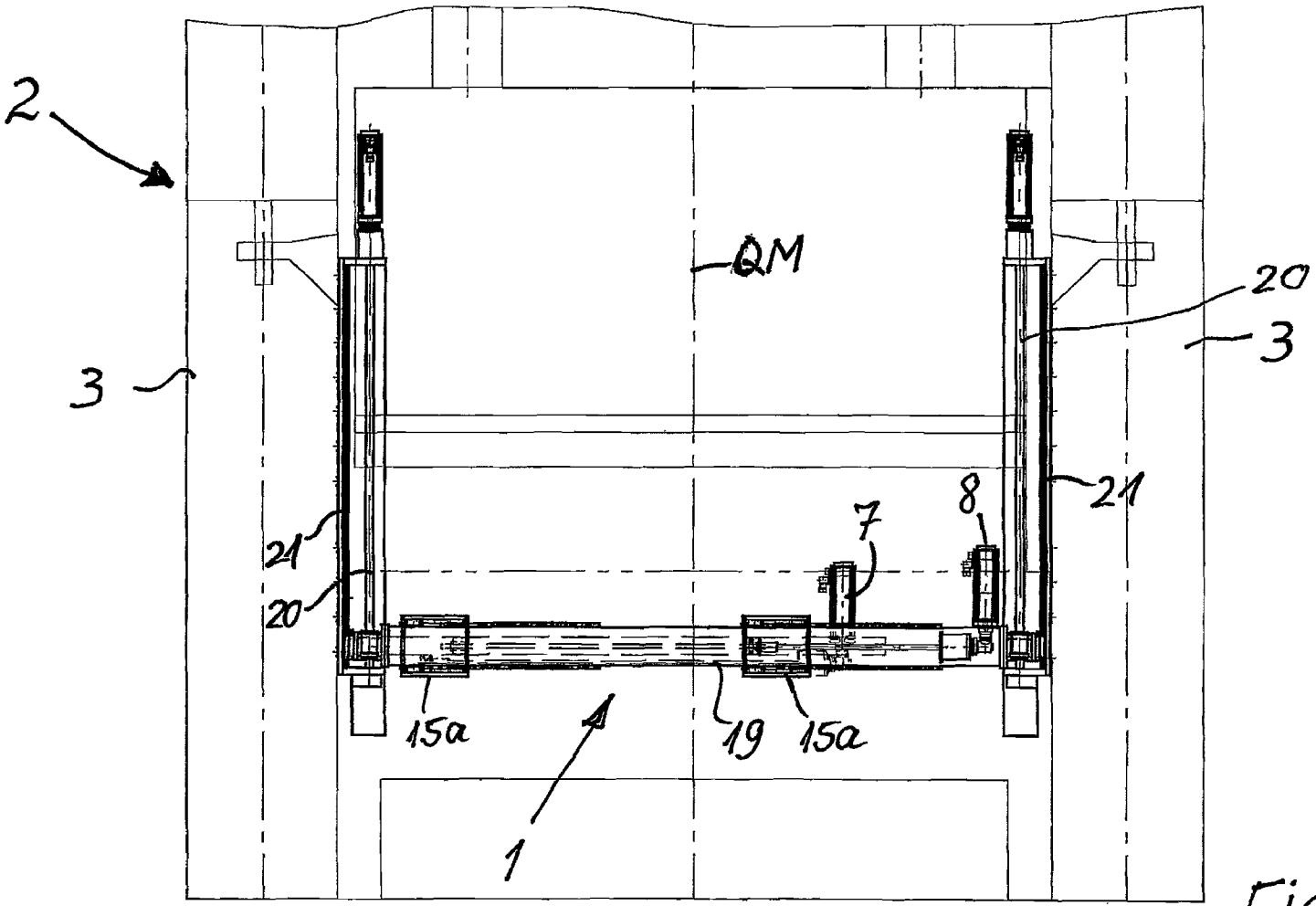
FIG. 1 a front view of a press shown only partially and in outline, and a device according to the invention is arranged between the stands of this press for stepped feeding of work pieces, which also is adjustable in height, FIG. 2 a top view of the arrangement according to FIG. 1, wherein stands of the press or similar processing equipment can be seen in outline in terms of its cross section and pivotable levers, as well as pivot arms used for their guide for the movements of the gripper rails perpendicular to their longitudinal extent are mounted on cross arms located between the stands, wherein two gripper rails that can move towards and away from each other are provided, FIG. 3 at an enlarged scale, a view of a gripper rail corresponding to FIG. 2 with its drive that is located, similar to the gripper rail itself, between two stands of the press or the like adjacent in the longitudinal direction of the gripper rail, FIG. 4 a representation according to FIG. 3 after a displacement of the gripper rail and its displacement drive in the direction of its longitudinal extent, FIG. 5 a representation according to FIG. 4 after a displacement of the gripper rail outwards away from the middle of the press, FIG. 6 a representation according to FIG. 5 after a displacement of the gripper rail adjusted outwards into the position according to FIG. 3, FIG. 7 a representation according to FIG. 3 of a modified embodiment, in which the adjustment and guide of the adjustment motion of the gripper rail can be executed perpendicular to its longitudinal extent or parallel to itself with the help of two crossing levers, FIG. 8 a representation according to FIG. 7 after a displacement of the gripper rail away from the middle of the press (and thus away from another not-shown gripper rail in a mirror-symmetric arrangement), FIGS. 9 to 14 end views of the device on a press with different spatial arrangement of the levers and the pivot arms, wherein the levers and pivot arms have different angles relative to the planes of motion.

In the embodiments described below, matching parts or parts that match in terms of function are provided with matching reference symbols, even for different configurations or different structural shapes.

A device designated as a whole with 1 is used, in particular, for the stepped displacement of work pieces, not shown in more detail, within an only partially shown or indicated press 2, in which the work pieces are subjected to an additional processing step after each feed motion or after each feed step.

Primarily for better understanding, in FIGS. 3 to 8 the centers of the press 2 are indicated by center lines between its press plungers 3, with the longitudinal center being designated with LM and the transverse center being designated with QM.

Analogous to DE 102 06 773 C1, the device 1 has two parallel gripper rails 4, which are also parallel to the longitudinal center LM, which can be moved and pulled back again in the direction of a longitudinal extent thereof and thus in the feed direction, and on which gripper parts or gripper zones for engaging the work pieces are provided in a way that is not described in more detail but is generally known. Here, FIGS. 3 to 8 simultaneously indicate that a device 1 could also be provided with only one gripper rail 4, if this rail has corresponding grippers or gripper parts for the work pieces.

For engaging such work pieces, the respective gripper rail 4 can move parallel to itself, in the case of two gripper rails 4, these can move towards each other and back away from each other for the release, while the already mentioned movements in the direction of the longitudinal extent of the gripper rails 4 are provided for the feed.

Figure 2:
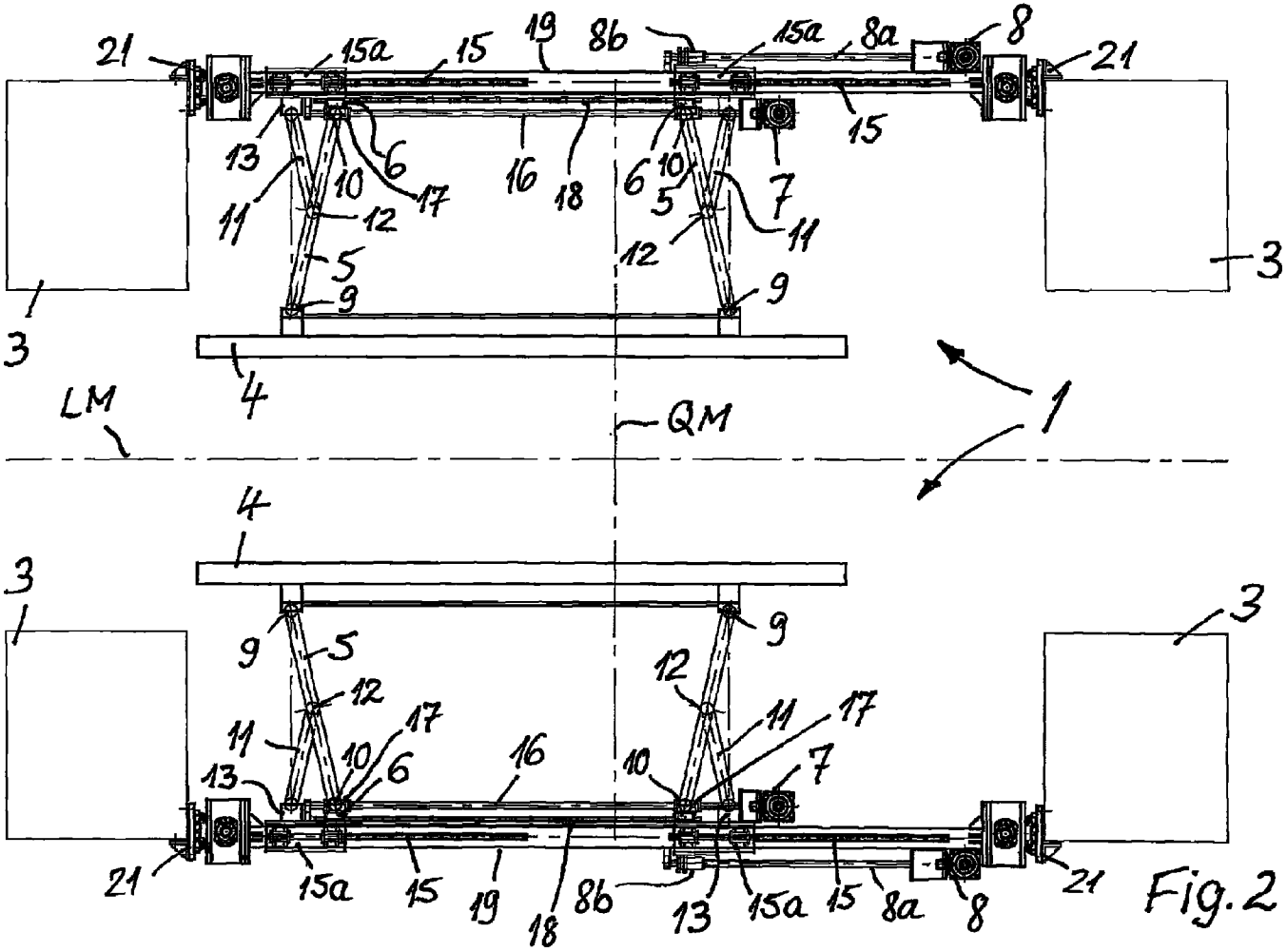
Figure 3:
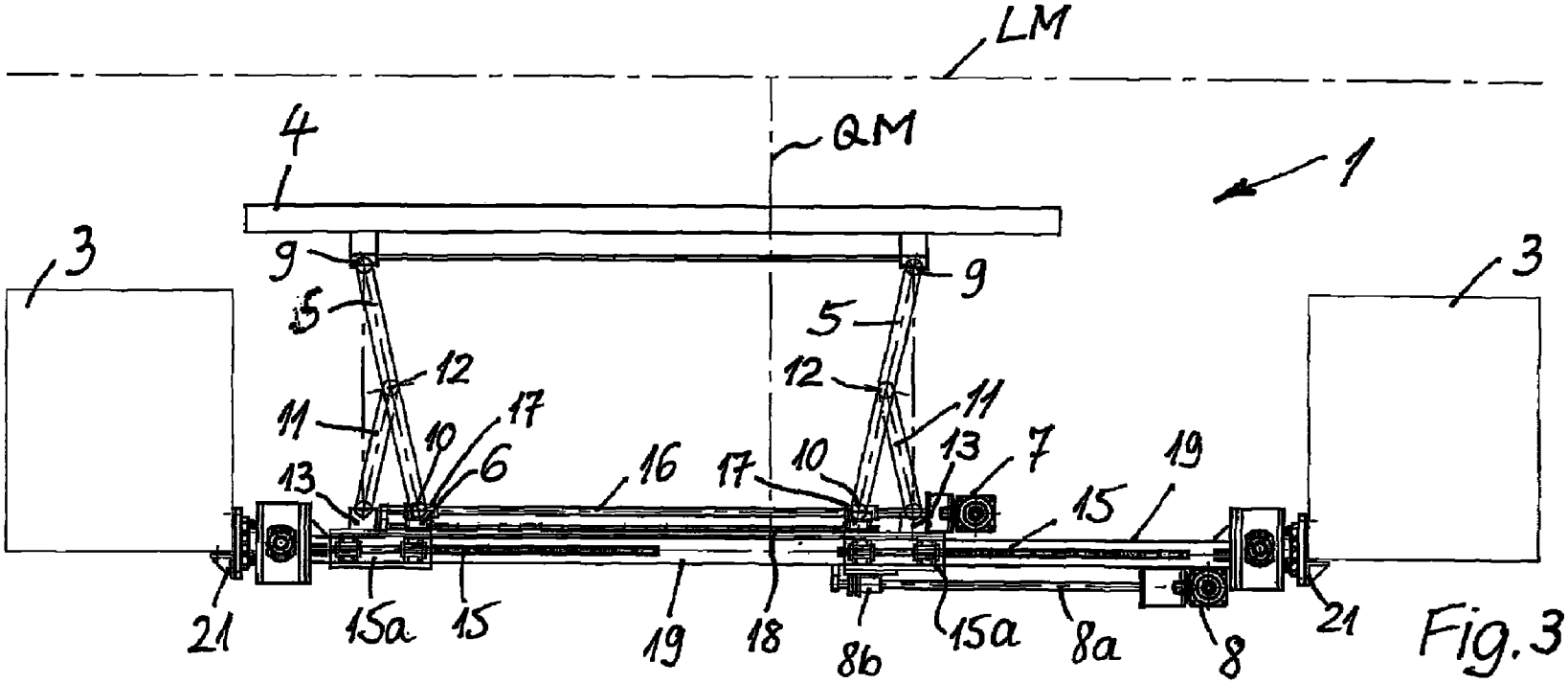
Figure 4:
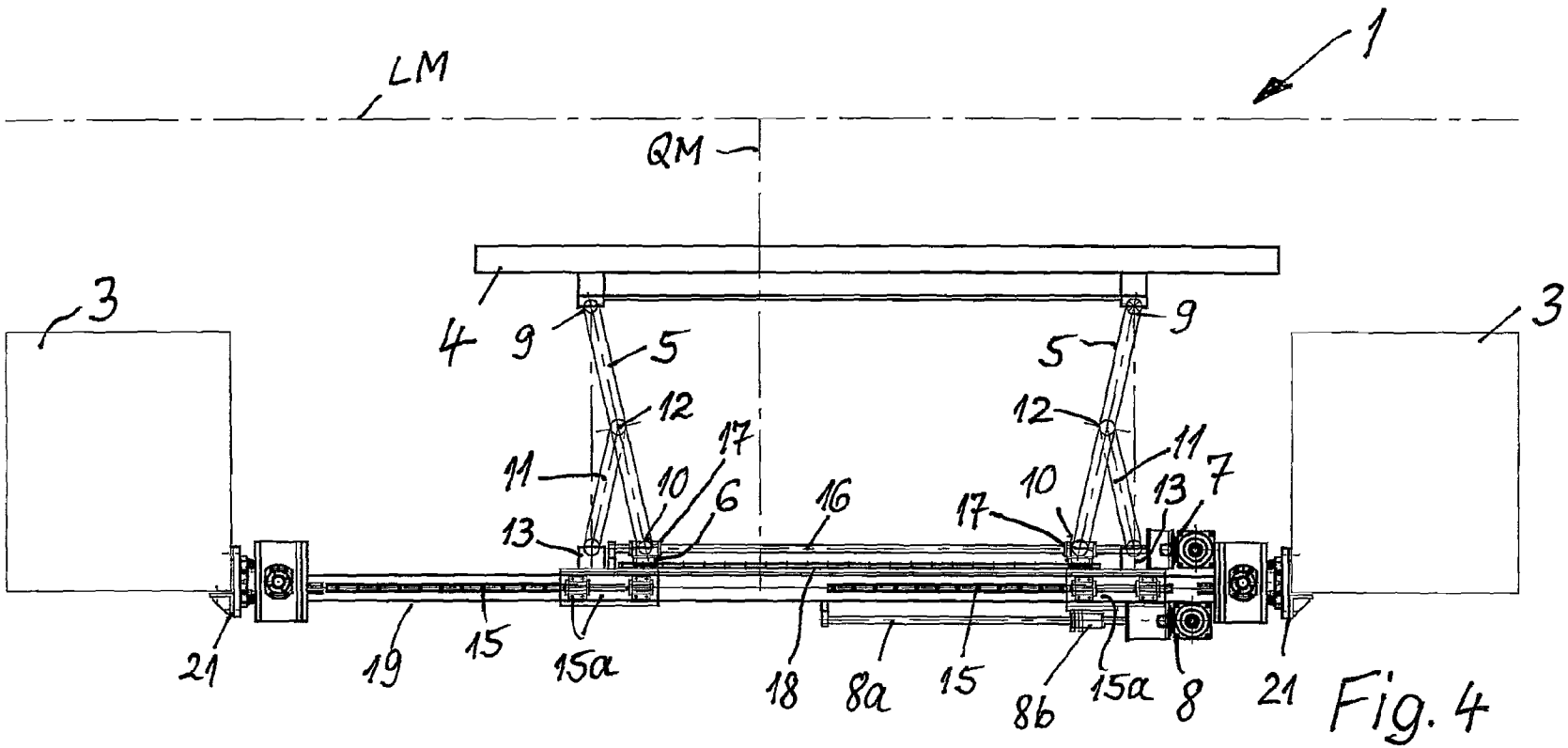

By comparing FIGS. 2, 3, and 4, one sees the gripper rail 4 first in a left position and then in a right position.

Figure 5:
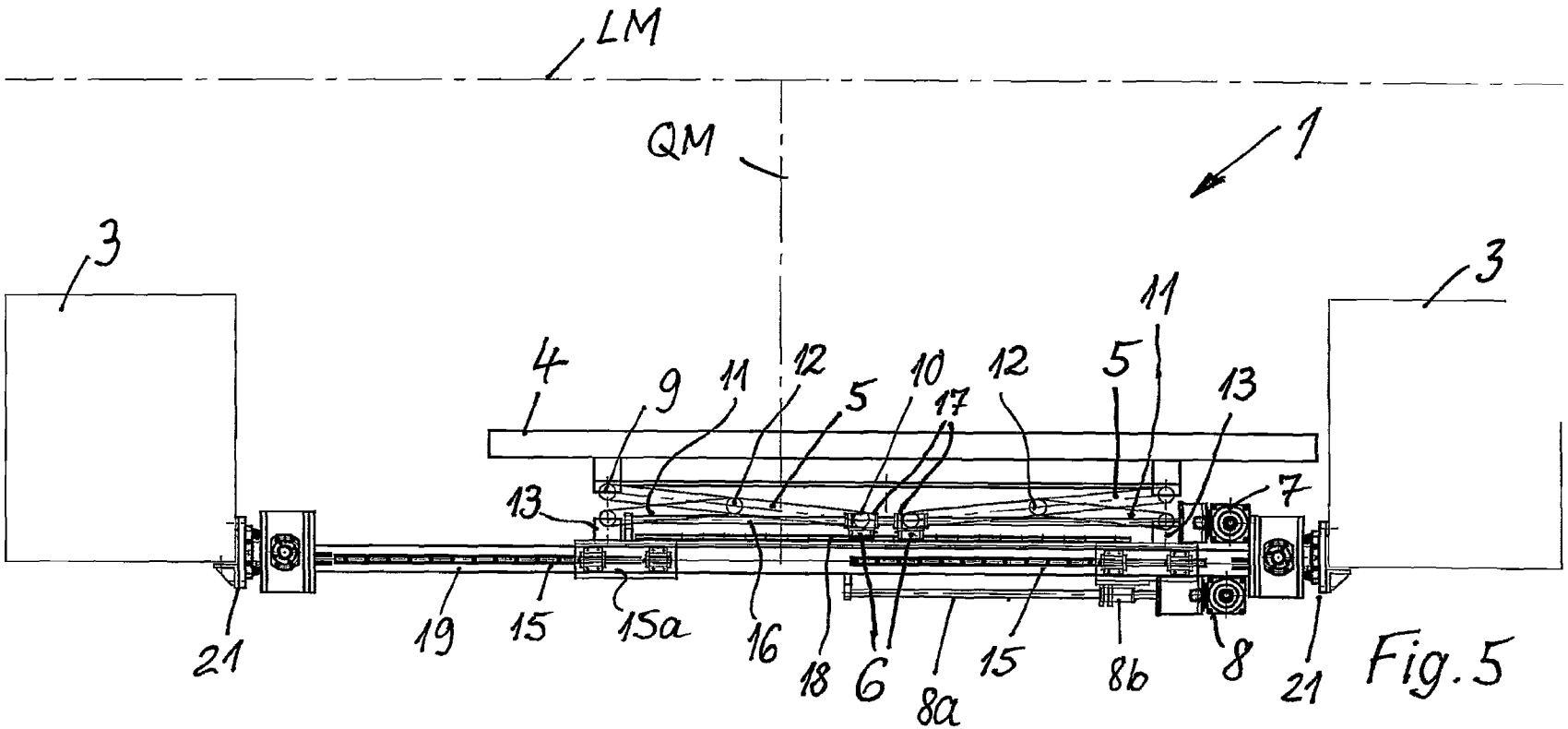
Figure 6:
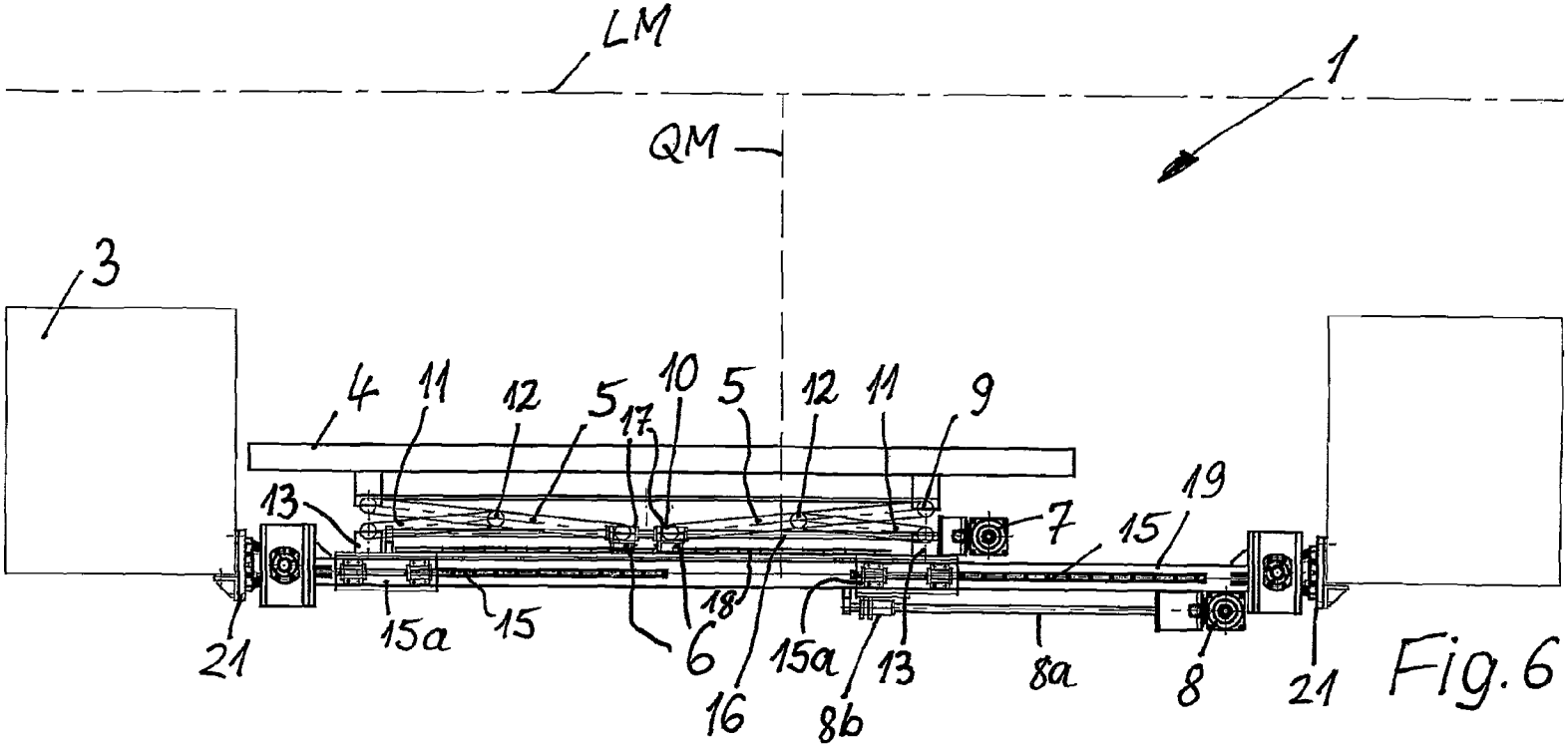

By comparing FIGS. 5 and 6, one sees an opposite feed motion of the gripper rail 4, which is moved away from the longitudinal center LM also parallel to itself in comparison with FIGS. 3 and 4 and thus has released one or more work pieces.

In all of the embodiments, two levers 5, which can pivot in parallel or in a mirror-symmetric arrangement relative to each other in the respective plane of motion, in a plane parallel to this plane of motion, or in a plane at an angle to this plane of motion, are attached to the gripper rails 4, wherein, for a device 1 with two parallel gripper rails 4, accordingly 2 of these levers 5 of one gripper rail 4 can pivot in the opposite direction relative to those of the other gripper rail 4, as is visible in FIG. 2.

In FIGS. 2 to 8 it is shown that the two levers 5 pivotably hinged to the gripper rail 4 are attached in an articulating way so that they can pivot with their ends or zones facing away from the gripper rail 4 on sliding parts 6 that can move towards or away from each other in parallel to the direction of the extent of the gripper rail 4, wherein the comparison of FIGS. 4 and 5 or 3 and 6 makes it clear that the spacing of these sliding parts 6 can be changed for the back and forth movements of the gripper rails 4 transverse to their longitudinal extent or parallel to themselves. The respective gripper rails 4 are also positively driven in a way still to be described transverse to the direction of their longitudinal extent.

If the two sliding parts 6 of the two levers 5 of one gripper rail 4 are arranged with the greatest possible spacing relative to each other, then the gripper rail 4 is at the closest position to the longitudinal center LM of the press, thus it assumes its engaging and conveying position.

Figure 8:
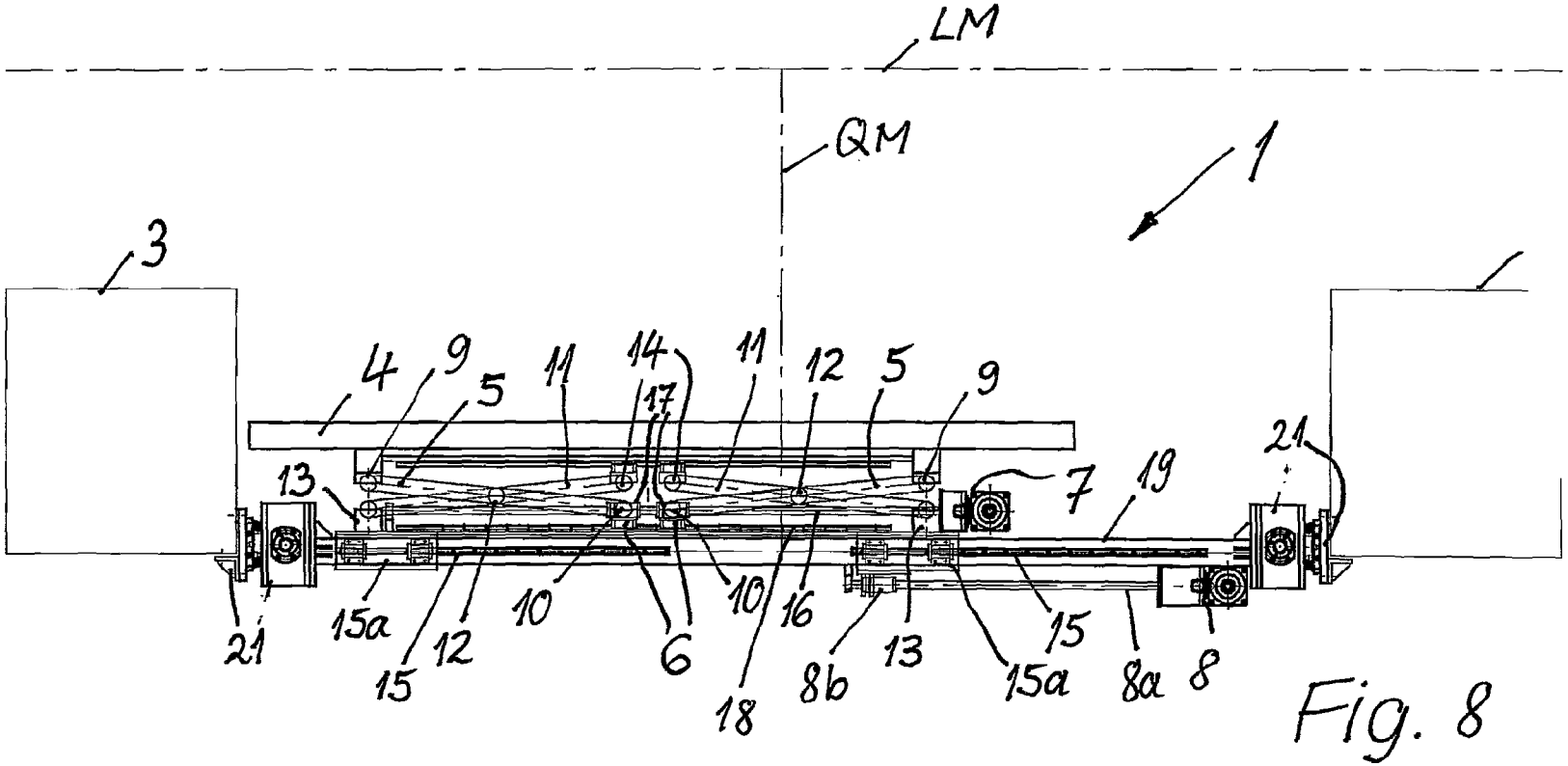

In contrast, if the sliding parts 5 according to FIGS. 5 and 6 or 8 approach each other, which pivots the levers 5 accordingly, the gripper rail 4 is located in its position farthest from the longitudinal center LM, in which position any work pieces are released. By moving the displacement parts 6 towards each other from the greatest possible distance, that is, the two levers 5 already at a somewhat inclined arrangement in the original position are retracted and therefore the gripper rail 4 moves away from the center LM parallel to itself, because the two levers 5 and their sliding parts 6 are arranged symmetric to each other and have matching dimensions.

Here, the levers 5 and the drive 7, which is still to be described for the sliding parts 6, are located practically completely within the outline of the stands 3 of the press 2 and, here, between two press stands 3, which are adjacent in the longitudinal direction and in the feed direction. Thus, the drive 7 and the levers 5 interacting with the drive requires no space outside of the horizontal projection of the press 2.

Also, the drive 8 for the feed movements of the gripper rail 4 or rails 4 is arranged in the direction of its longitudinal extent according to FIGS. 2 to 8 at least partially within the outline of the stands 3 of the press 2, wherein the minimal excess seen in FIG. 2 can be housed in all cases within the typical outline of protective doors found in such presses 2.

For the already mentioned positive drive of the motion of the gripper rails 4 parallel to themselves, pivot arms 11, which are mounted pivotably with their end facing away from the hinge point 12 and the gripper rail 4 on displacement elements or stationary bearings 13, are hinged, in turn, in an articulating way on the levers 5 between the hinged contact points 9 on the gripper rail 4 and the hinged contact points 10 on the respective sliding part 6. The spacing of the sliding part 6, on one side, and the displacement element or bearing 13, on the other side, can be changed and/or increased for the transverse movement or during the transverse movement of the gripper rail 4, as becomes clear from the comparison of FIGS. 4 and 5 or 7 and 8.

In the embodiments according to FIGS. 2 to 6, the pivot arm 11 runs only between its hinge point 12 and the bearing 13, which produces relatively simple kinematics with the help of the lever drive comprising the levers 5 and pivot arm 11. This arrangement practically corresponds to "single-arm scissors," which allow an effective transverse adjustment of the gripper rail 4.

Figure 7:
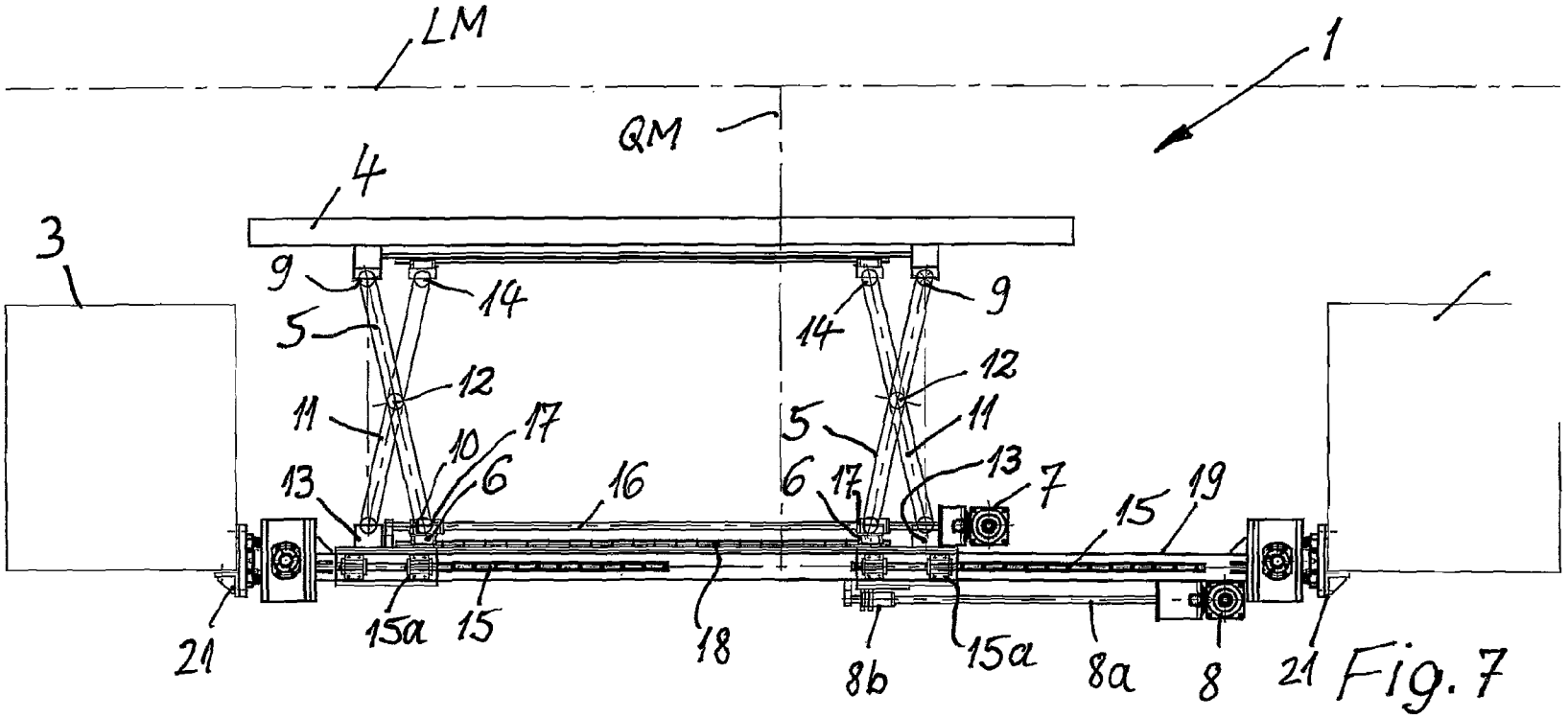

In the embodiment according to FIGS. 7 and 8, it is shown that the pivot arm 11 crosses the lever 5 at the common hinge point 12 and also attaches to the gripper rail by means of a joint 14, wherein the hinge points 9 and 14 of the lever 5 and the pivot arm 11 that can pivot on this lever on the gripper rail 4 can be changed in terms of its spacing when the gripper rail 4 is moved perpendicular to itself analogous to the spacing of the sliding part 6 and the displacement element or bearing 13, as made clear by the comparison of FIGS. 7 and 8. In the position according to FIG. 8 moved outwards away from the center LM, the joints 14 of the pivot arms 11 approach each other just like the sliding parts 6 of the lever 5. In this case, the arrangement comprising the levers 5 and pivot arm 11 involves "true" scissors, that is, in the embodiment according to FIGS. 7 and 8, the gripper rails 4 can be adjusted and driven positively perpendicular and parallel to themselves by scissor drives.

Here, it is advantageous that the hinge point of the pivot arm 11 located on the bearing 13 and facing away from the lever and the gripper rail 4 is stationary just like the hinge points 9 of the lever 5 on the gripper rail, that is, only the hinge point 10 of the lever 5 located on the respective sliding part 6 must be adjusted in the embodiment according to FIGS. 2 to 6.

The two sliding parts 6 of the two levers 5 attached to a gripper rail 4 can be moved towards each other for moving the gripper rail 4 closer to the sliding parts 6 or away or apart from each other for the engaging motion of two gripper rails 4. The hinge points on the bearings 13 of the pivot lever 11 advantageously remain stationary.

It was already mentioned that the gripper rails 4 can be moved into the position according to FIG. 4 after engaging work pieces, that is, in the position, for example, according to FIGS. 2 and 3 in the direction of their longitudinal extent. In the embodiments, this can be realized in that the hinge points 10 of the levers 5 and the hinge points or the bearing 13 of the pivot arms 11 each facing away from the gripper rail 4 can be moved by means of slides 15*a* on a guide 15 arranged parallel to the gripper rail 4 and that for this adjustment motion, for example, a spindle motor 8 with the threaded spindle 8*a* and the spindle nut 8*b*, which can be adjusted in the axial direction by the direction of the threaded spindle 8*a* and which is connected directly or indirectly to the slide or slides 15*a* or instead, a work cylinder or some other linear drive is provided. By comparing FIGS. 3 and 4 or 7 and 8, one can clearly see how the spindle nut 8*b* is moved in the axial direction relative to the spindle 8*a* by the motor 8 according to the position of the gripper rail 4 together with the slide 15*a* engaged by it.

For the motion of the sliding parts 6 in opposite directions for generating the transverse motion of the gripper rail 4 parallel to itself, in the exemplary embodiments there is a spindle 16 having two opposite-direction threaded zones and spindle nuts 17 having opposite-direction threads on the sliding parts 6. The respective threaded zones of the spindle 16 attach to these nuts so that they can rotate, wherein for the spindle 16 a single drive motor 7 is sufficient, in order to move both sliding parts 6 towards each other or away from each other.

The guide 18 of the sliding parts 6 that can move with the help of the spindle nuts 17 can be clearly seen in FIGS. 2 to 8. Here, it also becomes clear that this guide 18 and thus the displacement path 6 are arranged parallel to the longitudinal extent of the gripper rails 4.

The slides 15*a*, which have the hinge points 10 of the lever and the bearing 13 with the hinge points for the pivot arms 11 each facing away from the gripper rail 4, maintain their mutual spacing when they move, as becomes clear from the comparison of the individual figures, and thus can be coupled with each other or connected via a connecting rod, which can be arranged on the cross arm 19 having the guides 15. Thus, one feed drive 8, in the embodiment with the spindle 8*a*, is sufficient for each gripper rail 4 and its slides 14.

In FIGS. 9 to 14 it is shown in different arrangements that the pivot arm 11 attached to the respective lever 5 lies and is movable in a plane that extends at an angle to the plane in which the levers 5 are located and can pivot.

Figure 9:
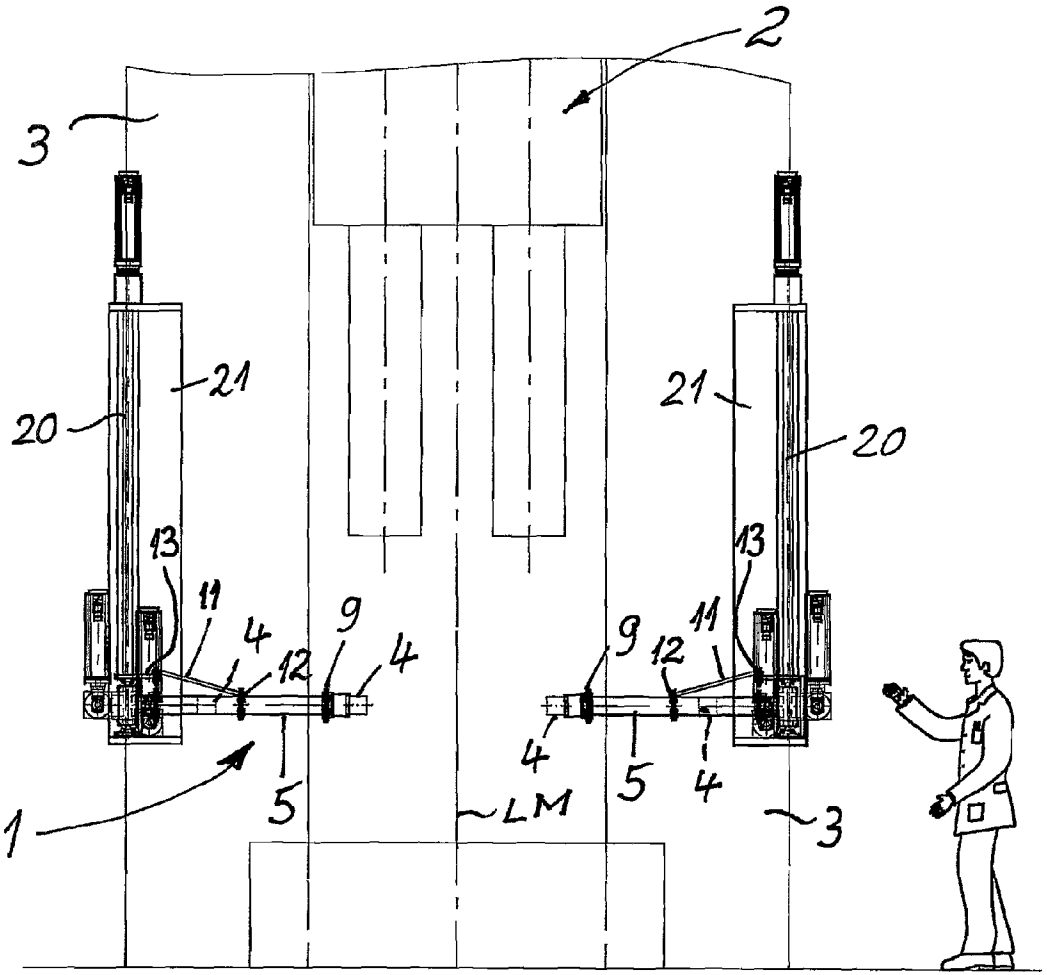

FIG. 9 shows an example, in which the relatively compact levers 5 are arranged horizontally and can pivot in a horizontal plane, in order to act on the gripper rails 4 accordingly, while, in contrast, the pivot arms 11 extend at an angle upwards.

Figure 10:
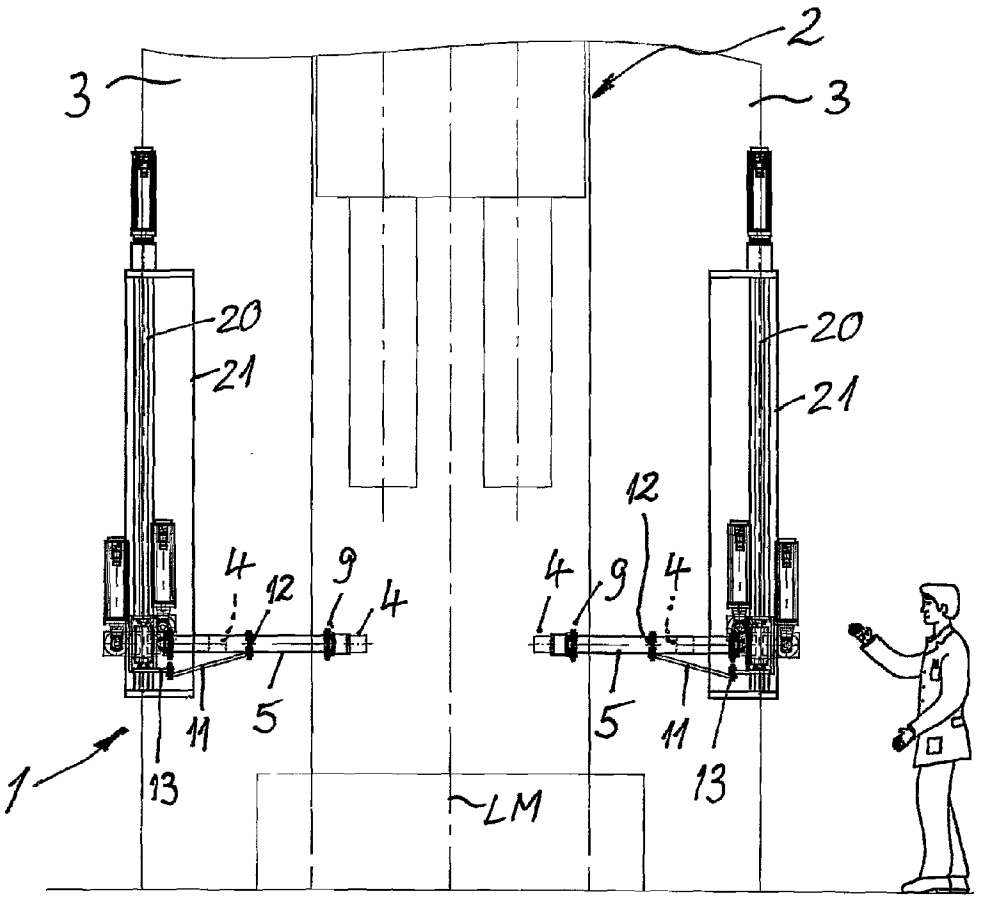

FIG. 10 shows an analogous arrangement, wherein, however, the pivot arms 11 extend at an angle downwards from their hinge point on the lever 5.

In the case of FIG. 9, the pivot arms 11 form tension rods, while in the embodiment according to FIG. 10 they form compression rods, wherein, however, in both cases they improve the carrying capacity or the flexural strength of the holder of the gripper rails 4.

In all of the embodiments according to FIGS. 9 to 14, the angle between the lever 5 and pivot arm 11 is an acute angle, whose vertex is arranged in or at the hinge point 12 of the pivot arm 11 on the lever 5.

Figure 11:
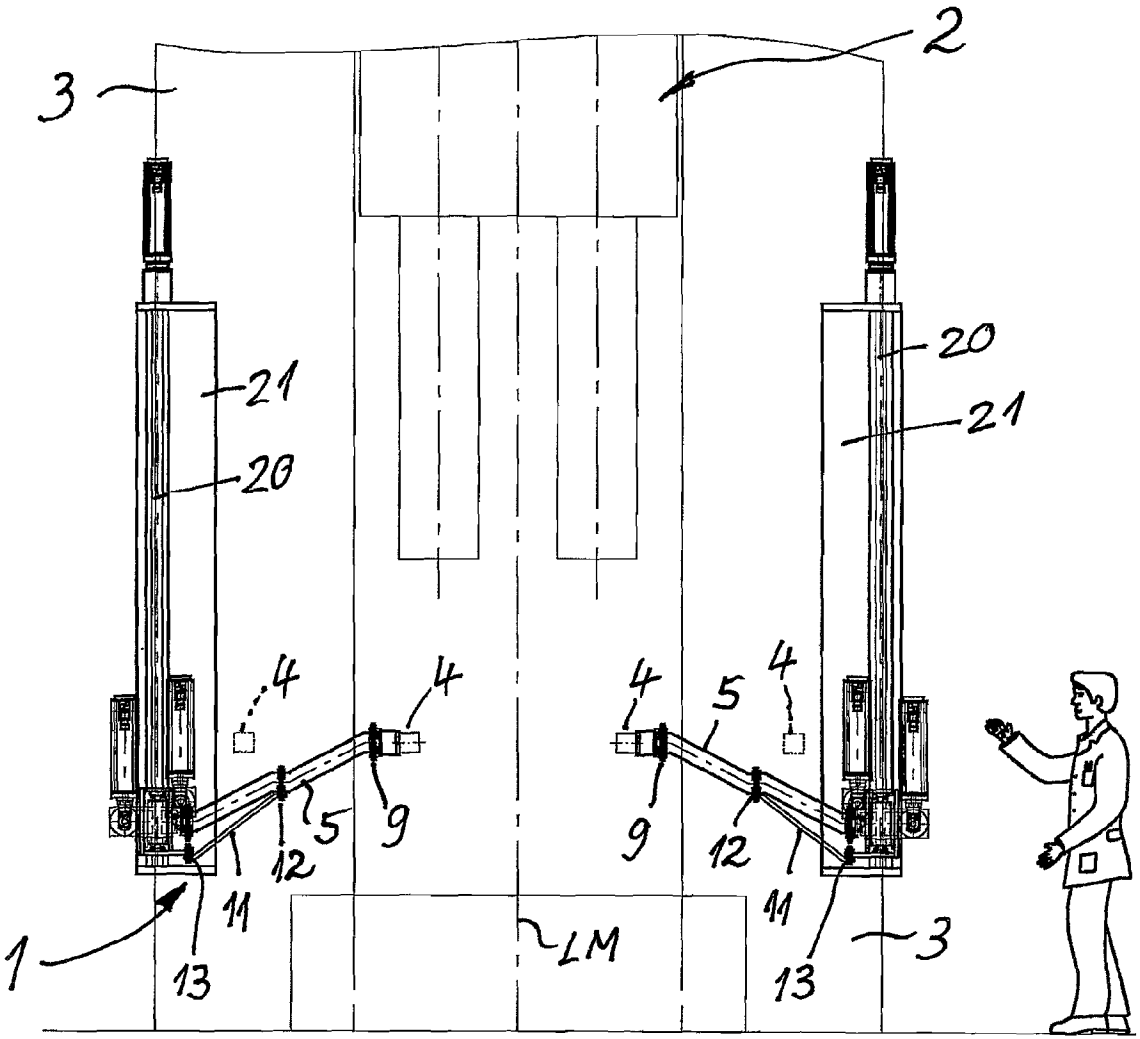
Figure 12:
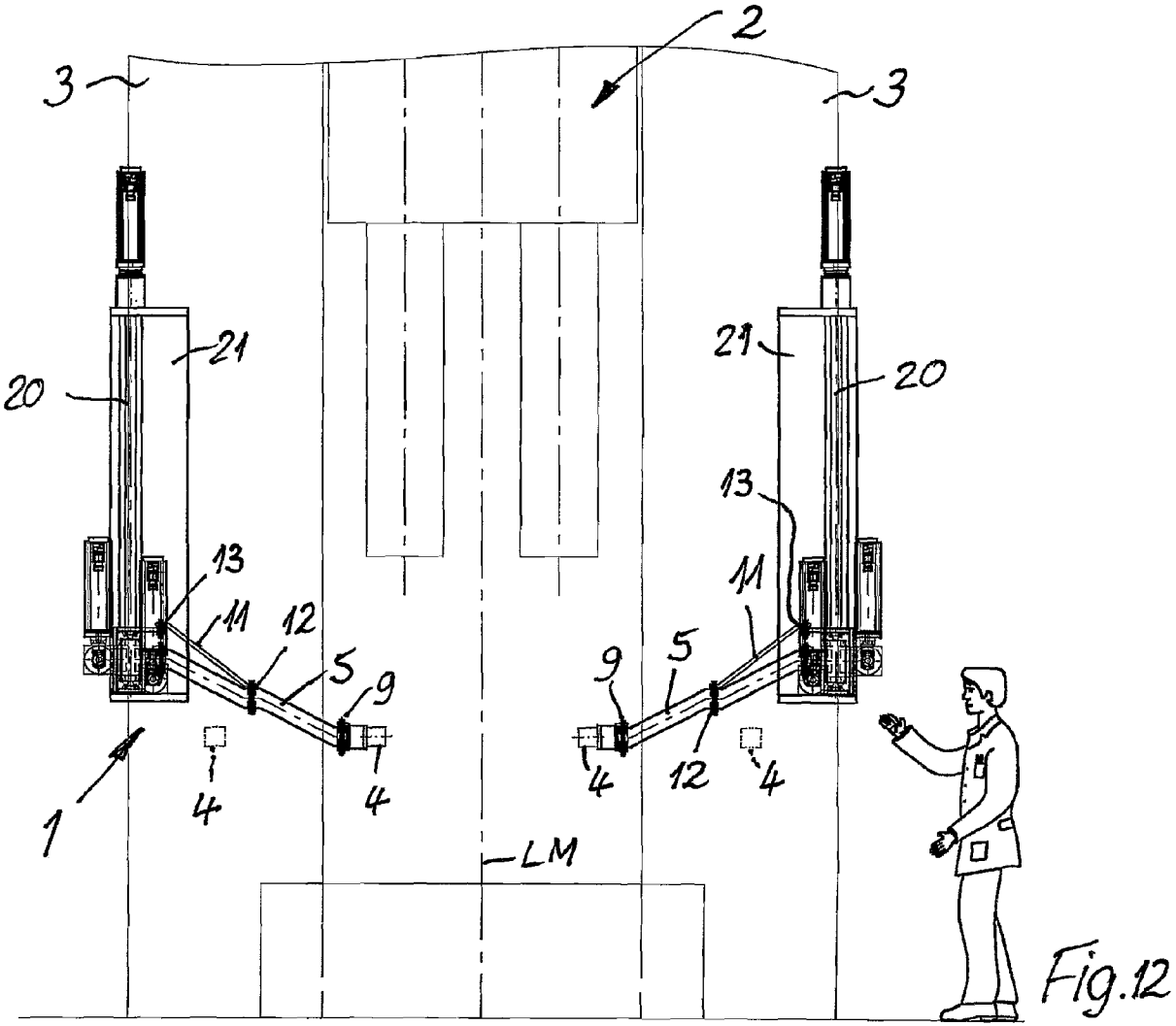

FIGS. 11 and 12 show examples, in which the levers 5, on their sides, are arranged at an angle to a horizontal plane and can move, wherein according to FIG. 11 the levers 5 are arranged at an angle upwards starting from the sliding parts 6 towards the gripper rail and in the opposite direction in FIG. 5. Nevertheless, in both cases, the pivot arms 11 are also arranged, in turn, at an angle to these levers 5 and their planes of motion. According to FIG. 11, the pivot arms 11 extend downwards at an angle from their hinge points 12 and are compression rods, while according to FIG. 12 they extend upwards at an angle opposite the lever 5 starting from the hinge points 12 and form tension rods.

Figure 13:
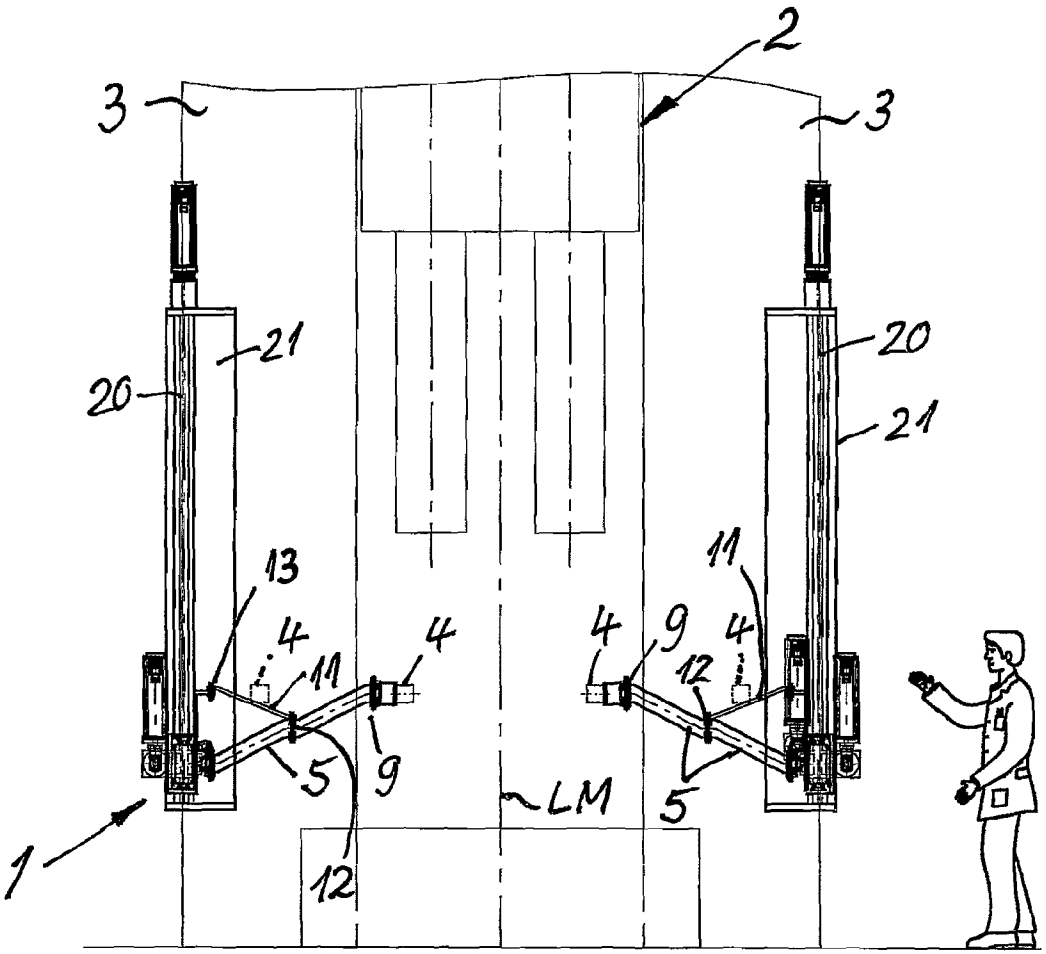
Figure 14:
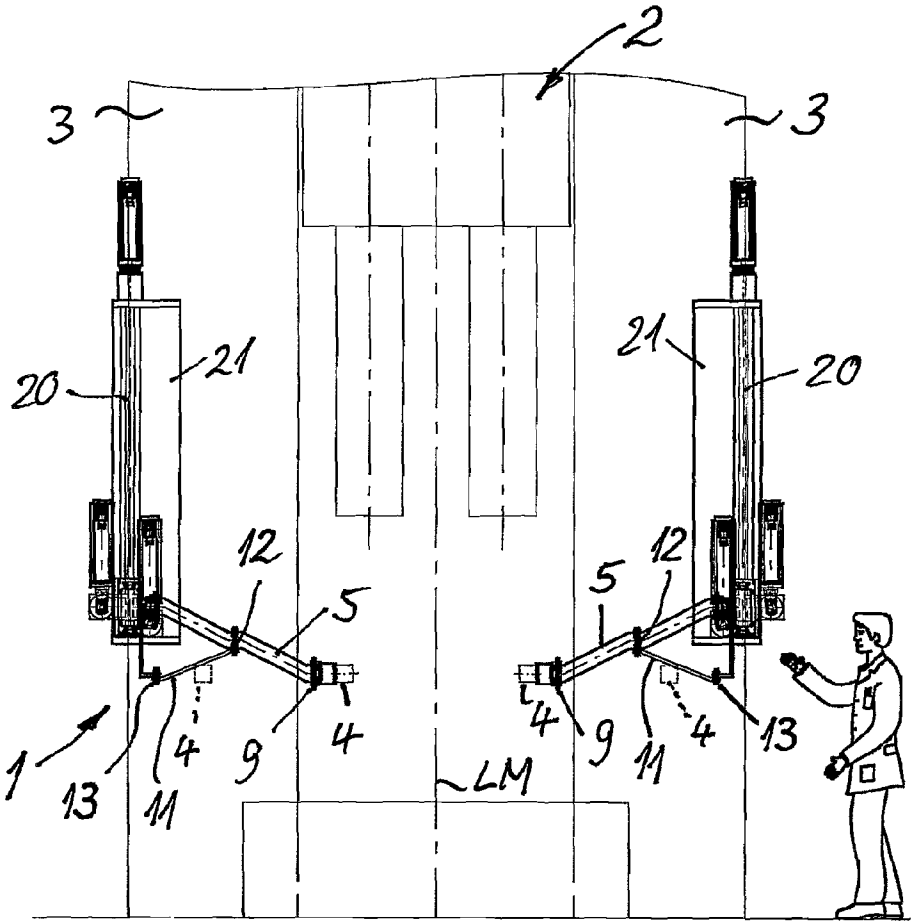

FIGS. 13 and 14 are also examples for angled levers 5, wherein FIG. 13 represents an example, in which the associated pivot arms arranged at an angle relative to the levers 5 are tension rods for levers 5 extending upwards at an angle, while the reverse arrangement according to FIG. 14 shows levers 5, which extend downwards at an angle to the gripper rails and on which angled pivot arms 11 located underneath act as compression rods.

In all of the embodiments, the pivot arms 11 extend opposite to the plane of motion of the lever 5 at an angle upwards or downwards independent of whether the plane of motion and the course of the lever 5 is arranged horizontally or also at an angle upwards or downwards relative to a horizontal plane. This angled position relative to the levers 5 give a double function to the pivot arms 11, in that they create a precise guide for the movement of the gripper rails 4 parallel to themselves and also reinforce the support system for the gripper rail 4 formed by the rails themselves and by the levers 5.

One can also see, primarily in FIG. 1, as well as in FIGS. 10 to 14, that the drive devices 7 and 8 with the slides 14 and their guides, as well as the cross arm 19, are mounted on vertical supports 21 fixed to the stands 3 and can move up and down by means of threaded spindles 20 and threaded nuts. Thus, the gripper rails 4 can also be adjusted in their height, that is, can execute lifting and lowering motions.

The device 1 for stepped displacement of work pieces within a press 2 or similar processing equipment has at least one or two gripper rails 4, which can move back and forth in a direction of their longitudinal extent and in the feed direction and which can be adjusted perpendicular to themselves for engaging work pieces. For this engaging motion, the gripper rail 4 has levers 5, which extend at an angle to the rail, which can move in opposite directions, and whose ends facing away from the gripper rail can move towards or away from each other, wherein for guiding the resulting transverse motion, pivot arms 11 are hinged to the levers 5, wherein these arms form scissors or single-arm scissors together with the levers 5. By means of such a scissors drive, the adjustment motion of the gripper rail 4 parallel to itself can also be executed in a very narrow space and without a drive projecting past the longitudinal extent of the gripper rails 4.

The invention claimed is:

1. Device (1) for stepped displacement of work pieces within a press (2), comprising at least one gripper rail (4), which is movable back and forth in a feed direction for feed and return motions, which has a gripper part for engaging work pieces, and which is movable for engaging the work pieces and for movements in the feed direction and then back into an original position, wherein at least two levers (5) that are pivotable are attached to the gripper rail (4), the two levers (5) are hinged to the gripper rail (4) so that they can pivot, and sliding parts (6) are located at ends of the two levers (5) facing away from the gripper rail (4), the ends of the two levers are pivotably attached to the sliding parts (6) and the sliding parts are movable towards each other or away from each other parallel to a direction of an extent of the gripper rail (4), and a spacing of the sliding parts (6) is changeable for movements of the gripper rail (4) in directions perpendicular to a longitudinal extent of the gripper rail (4), and the gripper rail (4) is driven positively perpendicular to a direction of the longitudinal extent thereof.

2. Device according to claim 1, wherein the levers (5) and a drive (7) of the sliding parts (6) are arranged at least partially within an outline of two press stands located adjacent to each other in the feed direction.

3. Device according to claim 2, wherein the drive for the feed motions of the gripper rail (4) is arranged in the direction of the longitudinal extent of the gripper rail at least partially within the outline of the press stands (3).

4. Device according to claim 1, wherein pivot arms (11), which are mounted pivotably with pivot arm ends thereof facing away from a hinge point (12) on the gripper rail (4) using displacement elements or stationary bearings (13), are hinged to the levers (5) between hinge points (9) of the levers to the gripper rail (4) and to the respective sliding part (6) and a spacing of the sliding part (6) and the displacement element or bearing (13) can be changed or enlarged for transverse adjustment or during the transverse adjustment of the gripper rail (4).

5. Device according to claim 4, wherein the pivot arm (11) crosses the lever (5) at the hinge point (12) and also attaches to the gripper rail via a joint (14), wherein the hinge points of the lever (5) and the pivot arm (11) mounted pivotably to the lever on the gripper rail (4) are changeable in terms of a spacing therebetween when the gripper rail (4) moves perpendicular to a longitudinal extent thereof in a similar manner to a spacing between the sliding part (6) and the displacement element or bearing (13).

6. Device according to claim 5, wherein the hinge point of the pivot arm (11) facing away from the lever and the gripper rail (4) is stationary and the hinge point (10) of the lever (5) adjacent to the other hinge point and located on the sliding part (6) is movable relative to the other hinge point.

7. Device according to claim 4, wherein the gripper rail (4) is movable after engaging the work pieces in the direction of the longitudinal extent thereof, such that the hinge points (10) of the levers (5) and the pivot arms (11) each facing away from the gripper rail (4) are movable by slides (15*a*) on a guide (15) arranged parallel to the gripper rail (4) and a spindle motor or work cylinder or a linear drive is provided for the adjustment motion.

8. Device according to claim 4, wherein the pivot arm (11) for attachment to the respective lever (5) is movable in a plane that extends at an angle to a plane in which the lever (5) is movable.

9. Device according to claim 8, wherein the pivot arms (11) extend at an angle upwards or downwards relative to the plane of motion of the levers (5) independent of whether the plane of motion of the levers (5) is arranged horizontally or at an angle upwards or downwards relative to a horizontal plane.

10. Device according to claim 1, wherein the two sliding parts (6) of the two levers (5) attached to the gripper rail (4) can move towards each other for moving the gripper rail (4) closer to the sliding parts (6) and away from each other for an engaging motion and the hinge points of the pivot arm (11) are stationary.

11. Device according to claim 1, wherein for opposite-direction movements of the sliding parts (6), a spindle (16) having two opposite-direction threaded zones and spindle nuts (17), which have opposite-direction threads on the sliding parts (6) and to which the respective threaded zones of the spindle (16) attach is provided, and the spindle (16) has a separate drive motor (7).

12. Device according to claim 1, wherein sleds (14) located on the gripper rail and hinge points (10) of the lever (5) facing away from the gripper rail (4) are coupled with each other or connected via a connecting rod and a separate feed drive (8) is provided for each of the at least one gripper rail (4).

13. Device according to claim 1, wherein the drive devices for the at least one gripper rail are mounted on at least one of vertical supports (21) or threaded spindles (20) and can move up and down.

14. Device according to claim 1, wherein the at least one gripper rail (4) comprises first and second gripper rails (4) which are arranged parallel to and facing one another, and the levers (5) of the first one of the gripper rails (4) pivot in an opposite direction to the levers (5) of the second one of the gripper rails (4).

15. Device according to claim 14, wherein a separate feed drive is provided for each of the gripper rails (4).

16. Device according to claim 1, wherein the at least two levers are pivotable parallel to each other in a plane of motion.

17. Device according to claim 1, wherein the at least two levers are pivotable mirror symmetric to each other in a plane of motion.

* * * * *